US012600916B2

(12) United States Patent
Clark et al.

(10) Patent No.: US 12,600,916 B2
(45) Date of Patent: Apr. 14, 2026

(54) OPEN GEAR LUBRICANT COMPOSITION

(71) Applicant: The Lubrizol Corporation, Wickliffe, OH (US)

(72) Inventors: Jennifer E. Clark, Aurora, OH (US); Robert D. Dura, Broadview Heights, OH (US); Carlos Alberto Nazario, Willoughby, OH (US); Yang Cao, Solon, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

(21) Appl. No.: 18/717,200

(22) PCT Filed: Dec. 1, 2022

(86) PCT No.: PCT/US2022/051505
§ 371 (c)(1),
(2) Date: Jun. 6, 2024

(87) PCT Pub. No.: WO2023/107327
PCT Pub. Date: Jun. 15, 2023

(65) Prior Publication Data

US 2025/0034473 A1 Jan. 30, 2025

Related U.S. Application Data

(60) Provisional application No. 63/287,381, filed on Dec. 8, 2021.

(51) Int. Cl.

| | |
|---|---|
| ***C10M 107/02*** | (2006.01) |
| ***C10M 113/08*** | (2006.01) |
| ***C10M 125/22*** | (2006.01) |
| ***C10M 125/26*** | (2006.01) |
| *C10N 10/02* | (2006.01) |
| *C10N 10/04* | (2006.01) |
| *C10N 10/12* | (2006.01) |
| *C10N 20/02* | (2006.01) |
| *C10N 20/04* | (2006.01) |
| *C10N 30/00* | (2006.01) |
| *C10N 30/06* | (2006.01) |

(52) U.S. Cl.
CPC ..... *C10M 107/02* (2013.01); *C10M 113/08* (2013.01); *C10M 125/22* (2013.01); *C10M 125/26* (2013.01); *C10N 2010/02* (2013.01); *C10N 2010/04* (2013.01); *C10N 2010/12* (2013.01); *C10N 2020/02* (2013.01); *C10N 2020/04* (2013.01); *C10N 2030/06* (2013.01); *C10N 2030/40* (2020.05)

(58) Field of Classification Search
CPC ..... C10N 2030/58; C10N 2020/04; C10N 2040/04; C10N 2010/04; C10N 2030/06; C10N 2020/02; C10N 2010/12; C10N 2010/02; C10N 2030/02; C10N 2030/40; C10M 61/00; C10M 125/22; C10M 125/26; C10M 113/08; C10M 107/02; C10M 2201/087; C10M 2215/064; C10M 2223/045; C10M 2219/022; C10M 2201/066; C10M 2205/16; C10M 2203/1025; C10M 2201/061; C10M 2205/022; C10M 2205/024
See application file for complete search history.

(56) References Cited

U.S. PATENT DOCUMENTS

| | | | | |
|---|---|---|---|---|
| 3,290,244 | A | 12/1966 | Polishuk et al. | |
| 6,300,288 | B1 | 10/2001 | Scharf et al. | |
| 6,559,105 | B2 | 5/2003 | Abraham et al. | |
| 7,285,516 | B2 | 10/2007 | Carrick et al. | |
| 2015/0266985 | A1* | 9/2015 | Uhm | C08F 210/16 526/160 |
| 2019/0225909 | A1* | 7/2019 | Miller | C10M 169/04 |
| 2021/0189284 | A1* | 6/2021 | Shimodate | C10M 141/12 |
| 2022/0186132 | A1* | 6/2022 | Abe | C10M 169/04 |

FOREIGN PATENT DOCUMENTS

| | | |
|---|---|---|
| CN | 104194876 | 12/2014 |
| EP | 3950892 | 2/2022 |
| WO | 2010014655 | 2/2010 |
| WO | 2020194550 | 10/2020 |

* cited by examiner

*Primary Examiner* — Vishal V Vasisth
(74) *Attorney, Agent, or Firm* — Christopher P. Demas; Michael Miller

(57) ABSTRACT

The invention provides an open gear lubricant composition containing a blend of ethylene-propylene copolymers and a metallic soap thickener. The blend of ethylene-propylene copolymers includes a first ethylene-propylene copolymer having a kinematic viscosity at 100° C. of 80 centistokes to 220 centistokes and a second ethylene-propylene copolymer having a kinematic viscosity at 100° C. 500 centistokes to 3000 centistokes. The invention further relates to a method of lubricating a mechanical device with the open gear lubricant composition.

22 Claims, No Drawings

OPEN GEAR LUBRICANT COMPOSITION

CROSS REFERENCE TO RELATED APPLICATION

This application claims priority from PCT Application Serial No. PCT/US2022/051505 filed on Dec. 1, 2022, which claims the benefit of U.S. Provisional Application No. 63/287,381 filed on Dec. 8, 2021.

FIELD OF INVENTION

The invention provides an open gear lubricant composition containing a blend of ethylene-propylene copolymers and a metallic soap thickener. The invention further relates to the use of the open gear lubricant composition.

BACKGROUND OF THE INVENTION

Open gear lubricants usually possess properties including tackiness to allow adhesion to gears, washout resistance, corrosion/finish/wear protection, and cushioning without buildup. The present invention provides a grease-type open gear lubricant that provides lubrication and wear protection in a machine operating at lower temperatures than other open gear lubricants. Lower operating temperatures along with lower wear can help extend the life of the equipment being lubricated. Lubricants with this composition of ethylene-propylene copolymers also exhibit improved low temperature flow characteristics when applied via closed systems. In addition, in some embodiments, this invention may also provide lower power consumption in some systems.

SUMMARY OF THE INVENTION

The present invention provides an open gear lubricant composition comprising a mixture of ethylene-propylene copolymers and a metallic soap thickener comprising the reaction product of a metal hydroxide and a complexing acid. More specifically, the open gear lubricant composition comprises at least 40 wt % of a first ethylene-propylene copolymer having a kinematic viscosity at 100° C. measured according to ASTM D445-21 of least about 80 centistokes up to about 220 centistokes, 5 wt % to 20 wt % of a second ethylene-propylene copolymer having a kinematic viscosity at 100° C. measured according to ASTM D445-21 of at least about 500 centistokes but not more than 3000 centistokes, and a metallic soap thickener.

In one embodiment, the invention provides an open gear lubricant composition comprising at least 40 wt % of a first ethylene-propylene copolymer having a kinematic viscosity at 100° C. measured according to ASTM D445-21 of least about 80 centistokes up to about 220 centistokes, wherein the first ethylene-propylene copolymer has a number average molecular weight (Mn) of about 1000 Daltons to about 4000 Daltons and contains 25 weight % to 50 weight % ethylene; 5 wt % to 20 wt % of a second ethylene-propylene copolymer having a kinematic viscosity at 100° C. measured according to ASTM D445-21 of at least about 500 centistokes but not more than 3000 centistokes, wherein the second ethylene-propylene copolymer has a number average molecular weight (Mn) of 4500 Daltons to 10,000 Daltons and 30 weight % to 55 weight % ethylene; and a metallic soap thickener, wherein the metallic soap thickener comprises or consists of a complexing acid, such as 12-hydroxycarboxylic acid or 12-hydroxystearic acid and a metal hydroxide, such as lithium hydroxide.

The invention also provides a method for lubricating a mechanical device. Such method comprises supplying to a mechanical device an open gear oil lubricant composition as described herein.

DETAILED DESCRIPTION OF THE INVENTION

The invention described herein provides an open gear lubricant composition comprising a blend of ethylene-propylene copolymers and a metallic soap thickener comprising a complexing acid and a metal hydroxide. The invention also includes a method for lubricating a mechanical device using the open gear lubricant composition described herein.

Ethylene-Propylene Copolymers

The open gear lubricant composition of the present invention comprises a blend of ethylene-propylene copolymers: a first ethylene-propylene copolymer and a second ethylene-propylene copolymer. Number average molecular weights as used herein are measured by gel permeation chromatography in tetrahydrofuran.

In an embodiment of the invention, the first ethylene-propylene copolymer has a kinematic viscosity at 100° C. of at least 80 centistokes up to about 220 centistokes. In one embodiment, the first ethylene-propylene copolymer has a number average molecular weight (Mn) of 1000 Daltons to 4000 Daltons. Ethylene-propylene copolymers useful as the first ethylene-propylene copolymer in this invention are commercially available, for example LUCANT™ HC-100 ethylene-propylene copolymer or LUCANT™ HC-150 ethylene-propylene copolymer. In one embodiment, the first ethylene-propylene copolymer contains at least 25 percent by weight to 50 percent by weight ethylene monomer units. The first ethylene-propylene copolymer makes up at least 40 weight percent of the open gear lubricant composition. In one embodiment, the first ethylene-propylene copolymer is at least 40% up to 93% by weight, for example, 40% to 80% by weight, or even 40% to 75% by weight, or even 40% to 60% by weight of the open gear lubricant composition of the present invention.

In an embodiment of the invention, the second ethylene-propylene copolymer has a kinematic viscosity at 100° C. of at least 500 centistokes, but no more than 3000 centistokes. In one embodiment, the second ethylene-propylene copolymer has a number average molecular weight (Mn) of 4500 Daltons to 10,000 Daltons. Ethylene-propylene copolymers useful as the second ethylene-propylene copolymer in this invention are commercially available, for example LUCANT™ HC-600 ethylene-propylene copolymer, LUCANT™ HC-1100 ethylene-propylene copolymer, or LUCANT™ HC-2000 ethylene-propylene copolymer. In one embodiment, the second ethylene-propylene copolymer contains at least 30 percent by weight to 55 percent by weight ethylene monomer units. The second ethylene-propylene copolymer makes up about 5 weight percent to about 20 weight percent of the open gear lubricant composition. In another embodiment, the second ethylene-propylene copolymer makes up about 5 weight percent to no more than 20 weight percent of the open gear lubricant composition.

The polydispersity (Mw/Mn) of the ethylene-propylene copolymers used herein may be in the range of 1.3 to 4 or 1.4 to 3 or 1.4 to 2. The ethylene-propylene copolymers may be prepared by known methods by polymerization of (typically) ethylene and an alpha olefin such as propylene using an $AlCl_3$ or $BF_3$ catalyst or by other known methods.

In some embodiments, the open gear lubricant of the present invention may, optionally, include an additional base oil. For example, such oils may include, but are not limited to, natural oils and synthetic fluids, oil derived from hydrocracking, hydrogenation, and hydrofinishing, unrefined, refined, re-refined oils or mixtures thereof.

Natural oils include animal oils, vegetable oils, mineral lubricating oils such as liquid petroleum oils and solvent-treated or acid-treated mineral lubricating oils of the paraffinic, naphthenic or mixed paraffinic-naphthenic types and oils derived from coal or shale or mixtures thereof.

Synthetic lubricating oils include hydrocarbon oils such as polymerized or oligomerized olefins (e.g., polybutylenes, polypropylenes, propylene-isobutylene copolymers); poly (1-hexenes), poly(1-octenes), trimers or oligomers of 1-decene e.g., poly(1-decenes), such materials being often referred to as poly {α-olefins, and mixtures thereof, alkylbenzenes (e.g. dodecylbenzenes, tetradecylbenzenes, dinonylbenzenes, di-(2-ethylhexyl)-benzenes); polyphenyls (e.g., biphenyls, terphenyls, alkylated polyphenyls); diphenyl alkanes, alkylated diphenyl alkanes, alkylated diphenyl ethers and alkylated diphenyl sulphides and the derivatives, analogs and homologs thereof or mixtures thereof.

Other synthetic lubricating oils include polyol esters (such as PRIOLUBE®3970), diesters, liquid esters of phosphorus-containing acids (e.g., tricresyl phosphate, trioctyl phosphate, and the diethyl ester of decane phosphonic acid), or polymeric tetrahydrofurans. Synthetic oils may be produced by Fischer-Tropsch reactions and typically may be hydroisomerised Fischer-Tropsch hydrocarbons or waxes. In one embodiment oils may be prepared by a Fischer-Tropsch gas-to-liquid synthetic procedure as well as other gas-to-liquid oils.

Unrefined oils are those obtained directly from a natural or synthetic source generally without (or with little) further purification treatment. Refined oils are similar to the unrefined oils except they have been further treated in one or more purification steps to improve one or more properties. Purification techniques are known in the art and include solvent extraction, secondary distillation, acid or base extraction, filtration, percolation, and the like.

Re-refined oils are also known as reclaimed or reprocessed oils and are obtained by processes similar to those used to obtain refined oils and often are additionally processed by techniques directed to removal of spent additives and oil breakdown products.

Base oils that may be included in some embodiments of the invention may also be defined as specified in the April 2008 version of "Appendix E—API Base Oil Interchangeability Guidelines for Passenger Car Motor Oils and Diesel Engine Oils", section 1.3 Sub-heading 1.3. "Base Stock Categories." The API Guidelines are also summarised in U.S. Pat. No. 7,285,516 (see column 11, line 64 to column 12, line 10). In one embodiment these base oils may be an API Group I, Group II, Group III, Group IV, Group V oil, or mixtures thereof. The oil could also be "re-refined" oil.

If included in the open gear lubricant composition of the present invention, the amount of the oil present may be the balance remaining after subtracting from 100% by weight the sum of the other required components, specifically, the blend of ethylene-propylene copolymers, metallic soap thickener, and any other optional performance additives in the composition.

One feature of the present invention is that the blend of ethylene-propylene copolymers described herein can replace base oils commonly used in open gear lubricant compositions or greases. In one embodiment, the open gear lubricant composition of the present invention is substantially free of added oils. As used herein "substantially free of added oils" means that no base oils as described herein are added to the open gear lubricant composition other than oils which may be present in any of the other components described herein. In one exemplary embodiment, the open gear lubricant composition of the present invention is substantially free of added oils including, but not limited to, natural oils and synthetic fluids, oil derived from hydrocracking, hydrogenation, and hydrofinishing, unrefined, refined, re-refined oils or mixtures thereof.

Thickener

Thickeners useful in the open gear lubricant composition of the present invention include simple metallic soap thickeners, metal salts of such acid-functionalized oils, or mixed soap thickeners in which one fatty acid is reacted with two different metals In one embodiment, the metallic soap thickener may be a lithium soap. In another embodiment, the metallic soap thickener may be a calcium soap. In still another embodiment, the thickener may be a mixed lithium and calcium metallic soaps. In another embodiment, the thickener may be an aluminum complex soap. Such metallic soap thickeners and the preparation thereof are well known in the art.

In one embodiment, the metal hydroxide is selected from lithium hydroxide, calcium hydroxide, sodium hydroxide, or mixtures thereof. In another embodiment, the metal hydroxide comprises or consists of lithium hydroxide. In still another embodiment, metallic soap thickener comprises or consists of a lithium hydroxide based metallic soap thickener and is present in the open gear lubricant composition in an amount sufficient to deliver 400 ppm to 3000 μm of lithium to the open gear lubricant composition. In some embodiments of the invention, the metallic soap thickener may include other metals which may be contained in the metal hydroxide as impurities, but which are not intentionally added to the composition.

In one embodiment, the complexing acid used in the manufacture of the metallic soap thickener is derived from a natural plant or animal oil. Examples of plant derived acids are oleic acid, 12-hydroxystearic acid, and ricinoleic acid. Hydrogenated castor oil, an impure derivative of castor oil containing glycerol, glycerides and 12-hydroxystearic acid may also be useful in preparing metallic soap thickeners. An example of animal derived fat is beef tallow.

The open gear lubricant composition of the present invention may include from about 2% by weight to about 10% by weight of the metallic soap thickener, for example 2 wt % to 8 wt % or even 3 wt % to 7 wt % metallic soap thickener.

Other Additives

The open gear lubricant composition of the present invention may also include one or more other additives. Such additives, either alone or in combination, may be present at levels of from 0% by weight to about 20% by weight, or 0.1% by weight to about 15% by weight, or about 0.5% to about 15% by weight of the total weight of the open gear lubricant composition.

Other performance additives useful in the open gear lubricant composition of the present invention include, but are not limited to, metal deactivators, viscosity modifiers, friction modifiers, anti-wear agents, corrosion inhibitors, tackifier, extreme pressure agents, anti-oxidants, and mixtures thereof. Typically, a fully-formulated open gear lubricant composition will contain at least one or more of these performance additives.

Antioxidants may be selected from diarylamine, alkylated diarylamines, hindered phenols, hydroxyl thioethers, trimethyl polyquinoline (e.g., 1,2-dihydro-2,2,4-trimethylquinoline), or mixtures thereof. In one embodiment the open gear lubricant composition includes at least one anti-oxidant and may contain a mixture of anti-oxidants. The anti-oxidant may be present at levels of 0% by weight to about 5% by weight, or about 0.05% by weight to about 3% by weight, or about 0.1% by weight to about 2.5% by weight, or about 0.2% by weight to about 1.5% by weight, or about 0.3% by weight to about 1% by weight of the total weight of the open gear lubricant composition.

In one embodiment, diarylamine and alkylated diarylamine used in the open gear lubricant composition herein may be selected from a phenyl-α-naphthylamine (PANA), an alkylated diphenylamine, or an alkylated phenylnapthylamine, or mixtures thereof. In another embodiment, the alkylated diphenylamine may include di-nonylated diphenylamine, nonyl diphenylamine, octyl diphenylamine, di-octylated diphenylamine, or di-decylated diphenylamine. The alkylated diarylamine may include octyl, di-octyl, nonyl, di-nonyl, decyl or di-decyl phenylnapthylamines. The alkylated diarylamine may be a tetra-alkylated diarylamine.

Hindered phenol anti-oxidants may also be useful in the open gear lubricant composition of the present invention. Hindered phenol anti-oxidants often contain a secondary butyl and/or a tertiary butyl group as a sterically hindering group. The phenol group may be further substituted with a hydrocarbyl group (typically linear or branched alkyl) and/or a bridging group linking to a second aromatic group. Examples of suitable hindered phenol anti-oxidants include 2,6-di-tert-butylphenol, 4-methyl-2,6-di-tert-butylphenol, 4-ethyl-2,6-di-tert-butylphenol, 4-propyl-2,6-di-tert-butylphenol or 4-butyl-2,6-di-tert-butylphenol, or 4-dodecyl-2,6-di-tert-butylphenol. In one embodiment the hindered phenol anti-oxidant may be an ester. A commercially available example of a hindered phenol ester anti-oxidant is IRGANOX™ L 135 from BASF. A detailed description of suitable ester-containing hindered phenol anti-oxidant chemistry is found in U.S. Pat. No. 6,559,105.

In one embodiment, the open gear lubricant composition may further comprise a tackifier. Useful tackifiers are known in the art and may include hydrogenated styrene-butadiene rubbers, ethylene-propylene copolymers, hydrogenated styreneisoprene polymers, hydrogenated diene polymers, polyalkyl styrenes, polyolefins, esters of maleic anhydride-olefin copolymers (such as those described in International Application WO 2010/014655), esters of maleic anhydride-styrene copolymers, or mixtures thereof. Tackifiers, such as those described in U.S. Pat. No. 6,300,288 may also be useful in this invention.

In one embodiment, the open gear lubricant composition may optionally include an additional polymeric viscosity modifier. The additional polymeric viscosity modifier useful in the present invention may be selected from polyolefins different from the ethylene-propylene copolymers used in the mixture of ethylene-propylene copolymers described herein, polymethacrylates, polyacrylates, or styrene-maleic anhydride copolymers reacted with an amine. In one embodiment, the additional polymeric viscosity modifier may comprise or consist of a polyolefin may be a polymer or oligomer of isobutene or butene or polyisobutylene having a number average molecular weight of 400 to 4000. In one embodiment, if a polymeric viscosity modifier is used in the present invention, it may be included in amounts of 2 wt % to 40 wt %, or even 3 wt % to 30 wt %, or even 3 wt % to 28 wt %, or even 5 wt % to 25 wt % of the open gear lubricating composition.

In one embodiment, the open gear lubricant composition may contain a friction modifier. The friction modifier may be present at levels of 0% to about 6% by weight, or about 0.01% by weight to about 4% by weight, or about 0.05% by weight to about 2% by weight, or about 0.1% by weight to about 2% by weight of the total weight of the open gear lubricant composition.

Friction modifiers may include materials such as sulfurized fatty compounds and olefins, molybdenum dialkyldithiophosphates, molybdenum dithiocarbamates, or other oil soluble molybdenum complexes. Commercially available friction modifiers include MOLYVAN® 855 (commercially available from Vanderbilt Chemicals LLC) or SAKURA-LUBE® S700 or SAKURA-LUBE® S710 (commercially available from Adeka, Inc.).

In one embodiment the friction modifier may be an oil soluble molybdenum complex. The oil soluble molybdenum complex may include molybdenum dithiocarbamate, molybdenum dithiophosphate, molybdenum blue oxide complex or other oil soluble molybdenum complex or mixtures thereof. The oil soluble molybdenum complex may be a mix of molybdenum oxide and hydroxide, so called "blue" oxide. The molybdenum blue oxides have the molybdenum in a mean oxidation state of between 5 and 6 and are mixtures of $MoO_2(OH)$ to $MoO_{2.5}(OH)_{0.5}$. An example of the oil soluble is molybdenum blue oxide complex known by the tradename of LUVODOR® MB or LUVODOR® MBO (commercially available from Lehmann and Voss GmbH). The oil soluble molybdenum complexes may be present at 0% by weight to 5% by weight, or 0.1% by weight to 5% by weight or 1% by weight to 3% by weight of the total weight of the open gear lubricant composition.

In one embodiment the friction modifier may be a long chain fatty acid ester. In another embodiment the long chain fatty acid ester may be a mono-ester and in another embodiment the long chain fatty acid ester may be a triglyceride such as sunflower oil or soybean oil or the monoester of a polyol and an aliphatic carboxylic acid.

In one embodiment, the open gear lubricant composition comprises an antiwear agent. Examples of suitable anti-wear agents include titanium compounds, tartrates, tartrimides, oil soluble amine salts of phosphorus compounds, sulfurized olefins, metal dihydrocarbyldithiophosphates (such as zinc dialkyldithiophosphates), phosphites (such as dibutyl or dioleyl phosphite), phosphonates, thiocarbamate-containing compounds, such as thiocarbamate esters, thiocarbamate amides, thiocarbamic ethers, alkylene-coupled thiocarbamates, bis(S-alkyldithiocarbamyl) disulfides, and oil soluble phosphorus amine salts. In one embodiment the open gear lubricant composition may further include metal dihydrocarbyldithiophosphates (such as zinc dialkyldithiophosphates).

In one embodiment, the open gear lubricant composition comprises an extreme pressure agent. The extreme pressure agent may be a compound containing sulfur and/or phosphorus and/or nitrogen. Examples of an extreme pressure agents include a polysulfide, a sulfurized olefin, a thiadiazole, or mixtures thereof.

Examples of a thiadiazole extreme pressure agent include 2,5-dimercapto-1,3,4-thiadiazole, or oligomers thereof, a hydrocarbyl-substituted 2,5-dimercapto-1,3,4-thiadiazole, a hydrocarbylthio-substituted 2,5-dimercapto-1,3,4-thiadiazole, or oligomers thereof. The oligomers of hydrocarbyl-substituted 2,5-dimercapto-1,3,4-thiadiazole typically form by forming a sulfur-sulfur bond between 2,5-dimercapto-1,3,4-thiadiazole units to form oligomers of two or more of said thiadiazole units. Examples of a suitable thiadiazole compound include at least one of a dimercaptothiadiazole, 2,5-dimercapto-[1,3,4]-thiadiazole, 3,5-dimercapto-[1,2,4]-thiadiazole, 3,4-dimercapto-[1,2,5]-thiadiazole, or 4-5-dimercapto-[1,2,3]-thiadiazole. Typically, readily available materials such as 2,5-dimercapto-1,3,4-thiadiazole or a hydrocarbyl-substituted 2,5-dimercapto-1,3,4-thiadiazole or a hydrocarbylthio-substituted 2,5-dimercapto-1,3,4-thiadiazole are commonly utilized. In different embodiments the number of carbon atoms on the hydrocarbyl-substituent group includes 1 to 30, 2 to 25, 4 to 20, 6 to 16, or 8 to 10. The 2,5-dimercapto-1,3,4-thiadiazole may be 2,5-dioctyl dithio-1,3,4-thiadiazole, or 2,5-dinonyl dithio-1,3,4-thiadiazole.

In one embodiment, polysulfide extreme pressure agents are used wherein at least 50% by weight of the polysulfide molecules are a mixture of tri- or tetra-sulfides. In other embodiments at least 55% by weight, or at least 60% by weight of the polysulfide molecules are a mixture of tri- or tetra-sulfides.

In one embodiment, a polysulfide extreme pressure agent may include a sulfurized organic polysulfide from oils, fatty acids or ester, olefins or polyolefins. Oils which may be sulfurized include natural or synthetic fluids such as mineral oils, lard oil, carboxylate esters derived from aliphatic alcohols and fatty acids or aliphatic carboxylic acids (e.g., myristyl oleate and oleyl oleate), and synthetic unsaturated esters or glycerides. Fatty acids which may be sulfurized include those that contain 8 to 30, or 12 to 24 carbon atoms. Examples of fatty acids include oleic, linoleic, linolenic, and tall oil. Sulfurized fatty acid esters prepared from mixed unsaturated fatty acid esters such as are obtained from animal fats and vegetable oils, including tall oil, linseed oil, soybean oil, rapeseed oil, and fish oil.

Polysulfide extreme pressure agents also may include sulfurized olefins derived from a wide range of alkenes. The alkenes typically have one or more double bonds. The sulfurized olefins in one embodiment contain 3 to 30 carbon atoms. In other embodiments, sulfurized olefins contain 3 to 16, or 3 to 9 carbon atoms. In one embodiment the sulfurized olefin includes an olefin derived from propylene, isobutylene, pentene or mixtures thereof. In one embodiment, the polysulfide comprises a sulfurized polyolefin derived from polymerizing by known techniques an olefin as described above.

In one embodiment the polysulfide includes dibutyl tetrasulfide, sulfurized methyl ester of oleic acid, sulfurized alkylphenol, sulfurized dipentene, sulfurized dicyclopentadiene, sulfurized terpene, and sulfurized Diels-Alder adducts.

The extreme pressure agent may be present in the open gear lubricant composition at a level of 0% by weight to about 10% by weight, about 0.01% by weight to about 8% by weight, about 0.01% by weight to about 5% by weight, about 0.05% by weight to about 3.5% by weight, about 0.1% by weight to about 1.5% by weight, or about 0.2% by weight to about 1% by weight of the open gear lubricant composition. For example, in some embodiments, the open gear lubricant composition may contain, as extreme pressure agents, 3% by weight to 8% by weight sulfurized olefin, 1% by weight to 3% by weight dispersed potassium borate, and 3% by weight to 7% by weight molybdenum disulfide.

In one embodiment, the open gear lubricant composition may also comprise a metal deactivator. Useful metal deactivators may include derivatives of benzotriazoles (typically tolyltriazole), 1,2,4-triazoles, benzimidazoles, 2-alkyldithiobenzimidazoles or 2-alkyldithiobenzothiazoles. The metal deactivators may also be described as corrosion inhibitors.

Corrosion inhibitors useful for a mechanical device include 1-amino-2-propanol, amines, triazole derivatives including tolyltriazole, dimercaptothiadiazole derivatives, octylamine octanoate, condensation products of dodecenyl succinic acid or anhydride and/or a fatty acid such as oleic acid with a polyamine.

In one embodiment, the open gear lubricant composition includes a boron compound, for example, a dispersed potassium borate or potassium borate salt. In one embodiment of the present invention, the boron compound, such as dispersed potassium borate, may be present in the open gear lubricant in amounts of up to 10% by weight of the open gear lubricant composition.

In another embodiment of the invention, the open gear lubricant may include a carbonaceous component, such as amorphous carbon, graphite or carbon black. The carbonaceous component may be at levels of 0% to about 7% by weight, or about 0.01% by weight to about 6% by weight, or about 0.05% by weight to about 4% by weight, or about 0.1% by weight to about 2% by weight of the total weight of the open gear lubricant composition.

In another embodiment, the open gear lubricant composition of the present invention comprises a phosphorous compound in an amount to deliver 300 ppm to 2000 ppm, phosphorous to the open gear lubricant composition. For example, the phosphorous compound may comprise or consist of a metal dialkyl phosphate. In one embodiment, the phosphorous compound may comprise or consist of zinc dialkyl dithiophosphate.

In another embodiment of the present invention, the open gear lubricant composition contains a sulfur-containing molybdenum compound, such as from molybdenum disulfide, molybdenum dithiocarbonate, and combinations thereof. The molybdenum compound may be present in amounts of from 3% to 7% by weight of the open gear lubricant composition. In another embodiment, the molybdenum compound may be present in amounts sufficient to deliver 2% to 5% by weight molybdenum to the open gear lubricating composition.

INDUSTRIAL APPLICATION

The open gear lubricant composition of the present invention may be employed to in applications requiring a lubricant or grease composition. The open gear lubricant compositions of the present invention enable lower operating temperatures over greases made with conventional base oils as well as providing lower power consumption.

In one embodiment of the present invention, the open gear lubricant composition has the properties or profile of a grease based on the the consistency of the open gear lubricant. Because a lubricating grease is a non-Newtonian semi-solid material, viscosity cannot be measured in the same way that a measurement would be made for a liquid lubricant. Rather, the "consistency" of a grease refers to how stiff the grease is under prescribed test conditions. Grease consistency is measured by a cone penetration test. Such tests are defined by various standards such as ISO 2137, ASTM D217, or ASTM D1403. The results of this test allow a consistency class e.g. #2 to be assigned to the grease according to a classification system established by the NLGI (formerly known as the National Lubricating Grease Institute). Softer greases will generally have a higher penetration number according to cone penetration tests. Comparisons of grease properties are generally done for greases in the same consistency class. In the present invention, the open-gear lubricant has a cone penetration of 0 or 00 as measured ASTM D1403.

In an embodiment, the present technology provides a method of operating a mechanical device comprising supplying to the mechanical device an open gear lubricant composition comprising at least 40 wt % of a first ethylene-propylene copolymer having a kinematic viscosity at 100° C. measured according to ASTM D445-21 of least about 80 centistokes up to about 220 centistokes, 5 wt % to 20 wt % of a second ethylene-propylene copolymer having a kinematic viscosity at 100° C. measured according to ASTM D445-21 of at least about 500 centistokes but not more than 3000 centistokes, and a metallic soap thickener.

The open gear lubricant of the present invention may be used in any applications which are subject to extreme contact pressures or reversing loads that may operate in various weather conditions. Examples of applications include, open gears, racks, bushings, rails, rollers, dipper handles, couplings, or labyrinth seals. The open gear lubricant of the present invention is capable of being dispensed through a centralized lubrication system (spray nozzles, injectors, lines and metering blocks). In some embodiments, the open gear lubricant of the present invention is capable of being dispensed at the lowest anticipated operating temperature to the most remote application point of the device to be lubricated.

The invention herein is useful for improving the performance of open gear lubricants, which may be better understood with reference to the following examples, which are non-exhaustive and are not intended to limit the scope of the invention.

Preparation of Open Gear Lubricants

A series of open gear lubricants were prepared to NLGI grade 0, according to ASTM D1404, 400 mm). The open gear lubricants were formulated with conventional additives and several different synthetic thickeners as set forth in Table 1.

Open gear lubricant compositions were prepared by first providing a base oil with viscosity of 2000 cSt at 40° C. The resulting base compositions were then additized to the final formulation and cut to NLGI grade 0 (determined by ASTM D1403). The compositions are summarized in Table 1.

TABLE 1

Open Gear Lubricant Compositions[1]

| | Example 1 wt % | Example 2 wt % | Example 3 wt % |
|---|---|---|---|
| Mineral Oil[2] | 40.8 | | |
| 3000 Mn Polyisobutylene | 36.6 | | 12.9 |
| Ethylene-Propylene copolymer (32 wt % Ethylene; 2600 Mn) | | 60.8 | |
| Ethylene-Propylene copolymer (43 wt % Ethylene; 5900 Mn) | | 15.2 | |
| PAO-100 | | | 64.0 |
| Hydrocarbon wax[3] | 4.6 | 5.7 | 4.9 |
| Dispersed LiOH (includes 53 wt % oil) | 1.1 | 1.3 | 1.2 |
| Sulfurized olefin | 6.3 | 6.3 | 6.3 |
| Dispersed Potassium Borate (includes 42 wt % oil) | 2 | 2 | 2 |
| ZDDP (includes 10 wt % oil)[3] | 1 | 1 | 1 |
| Alkylated diarylamine | 0.25 | 0.25 | 0.25 |
| Molybdenum Disulfide | 6 | 6 | 6 |
| Other additives[4] | 1.45 | 1.45 | 1.45 |
| Lithium | 0.11 | 0.14 | 0.12 |
| Phosphorus | 0.095 | 0.095 | 0.095 |
| Sulfur | 11.8 | 5.7 | 5.7 |
| Boron | 0.15 | 0.15 | 0.15 |
| Molybdenum | 3.6 | 3.6 | 3.6 |
| Zinc | 0.093 | 0.093 | 0.093 |
| Potassium | 0.17 | 0.17 | 0.17 |

[1]All treat rates are oil free, unless otherwise indicated
[2]150 Bright Stock mineral oil (Kinematic viscosity at 100 C. of 32 cSt)
[3]12-Hydroxtstearic acid
[4]Other additives include corrosion inhibitors, amine phosphate extreme pressure agent, and polymeric tackifier Evaluation Each of the open gear lubricant compositions from Table 1 were prepared independently by cooking the base grease with the specified oils and polymers in a manner typical for producing a lithium grease. The thicker base greases were then cut to grade and blended in a Hobart mixer with additives for 2 hours and then finally processed through a 3-roll mill twice and de-aerated. Each Example open gear lubricant composition was evaluated by a series of tests summarized below (Table 2).

TABLE 2

| | EX1 | EX2 | EX3 |
|---|---|---|---|
| 4-ball weld (kg) (ASTM D2596) | >800 | >800 | >800 |
| 4-ball wear (mm) (ASTM D2266) | 0.71 | 0.45 | 0.68 |
| Copper corrosion rating (100° C., 24 h) (ASTM D4048) | 1B | 1B | 1B |

The open gear lubricant compositions of Table 1 were also evaluated in the 12 stage FZG test for load carrying capacity and conducted in accordance with the latest version of ISO/DIN 14635-3. Conditions for the data presented in table 3 were A/2.8/50. FZG is capable of providing a measure of grease temperature and power consumption for a given torque. The results determined at 534.5 Nm torque is summarized below (Table 3).

TABLE 3

| | EX1 | EX2 | EX3 |
|---|---|---|---|
| Temperature[1] (° C.) | 91.79 | 70.48 | 85.20 |
| Temperature Reduction (relative to EX1) (° C.) | 0 | 21.31 | 6.59 |
| Consumed Power[2] (kWatts) | 1.473 | 1.172 | 1.243 |
| Consumed Power Reduction (relative to EX1 (%)) | 0 | 20.4 | 15.6 |

[1]Maximum operating temperature measured by the FZG test.
[2]Energy used by the test unit to turn the gear sets for the FZG test.

It is known that some of the materials described above may interact in the final formulation, so that the components of the final formulation may be different from those that are initially added. The products formed thereby, including the products formed upon employing open gear lubricant compositions of the present invention in its intended use, may not be susceptible of easy description. Nevertheless, all such modifications and reaction products are included within the scope of the present invention; the present invention encompasses open gear lubricant compositions prepared by admixing the components described above.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil, which may be customarily present in the commercial material, unless otherwise indicated. It is to be understood that the upper and lower amount, range, and ratio limits set forth herein may be independently combined. Similarly, the ranges and amounts for each element of the invention may be used together with ranges or amounts for any of the other elements.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. An open gear lubricant composition comprising:

(a) at least 40 wt % of a first ethylene-propylene copolymer having a kinematic viscosity at 100° C. measured according to ASTM D445-21 of least about 80 centistokes up to about 220 centistokes and a number average molecular weight (Mn) of 1000 Daltons to 4000 Daltons;

(b) 5 wt % to 20 wt % of a second ethylene-propylene copolymer having a kinematic viscosity at 100° C. measured according to ASTM D445-21 of at least about 500 centistokes but not more than 3000 centistokes and a number average molecular weight (Mn) or 4500 Daltons to 10,000 Daltons;

(c) a metallic soap thickener, and wherein the open gear lubricant composition is substantially free of added base oil.

2. The open gear lubricant composition of claim 1, wherein the first ethylene-propylene copolymer contains 25wt % to 50wt % ethylene.

3. The open gear lubricant composition of claim 1, wherein the second ethylene-propylene copolymer contains 30 wt % to 55 wt % ethylene.

4. The open gear lubricant composition of claim 1, further comprising a phosphorous compound in an amount to deliver 300 ppm to 2000 ppm, phosphorous to the open gear lubricant composition.

5. The open gear lubricant composition of claim 4, wherein the phosphorous antiwear agent comprises of a metal dialkyl phosphate.

6. The open gear lubricant composition of claim 5, wherein the metal dialkyl phosphate comprises of zinc dialkyl dithiophosphate.

7. The open gear lubricant composition of claim 1, wherein the open gear lubricant composition comprises 2 wt % to 10 wt % of the metallic soap thickener.

8. The open gear lubricant of claim 1, wherein the metallic soap thickener comprises the reaction product of a complexing acid and a metal hydroxide is selected from lithium hydroxide, calcium hydroxide, sodium hydroxide, and mixtures thereof.

9. The open gear lubricant composition of claim 8, wherein the metal hydroxide is selected from lithium hydroxide, calcium hydroxide, or aluminum alkoxide.

10. The open gear lubricant composition of claim 9, wherein the metal hydroxide comprises of lithium hydroxide.

11. The open gear lubricant composition of claim 10, wherein the metallic soap thickener is present in an amount to deliver 500 ppm to 3000 ppm lithium to the composition.

12. The open gear lubricant composition of claim 8 wherein the complexing acid comprises of a fatty acid or derivative of castor oil.

13. The open gear lubricant composition of claim 8, wherein the complexing acid comprises of 12-hydroxycarboxylic acid.

14. The open gear lubricant composition of claim 13, wherein the 12-hydroxycarboxylic acid is 12-hydroxystearic or ricinoleic, or mixtures thereof.

15. The open gear lubricant composition of claim 1 further comprising a sulfur-containing molybdenum compound.

16. The open gear lubricant composition of claim 15, wherein the sulfur-containing molybdenum compound is selected from molybdenum disulfide, molybdenum dithiocarbonate, and combinations thereof.

17. The open gear lubricant composition of claim 15, wherein the open gear lubricant composition comprises 3% to 7% by weight of the sulfur containing molybdenum compound.

18. The open gear lubricant composition of claim 1, further comprising a boron compound.

19. The open gear lubricant composition of claim 18, wherein the boron compound is a potassium borate salt.

20. The open gear lubricant composition of claim 18, wherein the boron compound is present in an amount to deliver 800 ppm to 3000 ppm of boron to the composition.

21. The open gear lubricant composition of claim 1 further comprising one or more additives.

22. A method for lubricating a mechanical device, comprising supplying thereto the open gear lubricant composition of claim 1.

* * * * *